US011280012B2

(12) United States Patent
Park et al.

(10) Patent No.: US 11,280,012 B2
(45) Date of Patent: Mar. 22, 2022

(54) METHOD FOR MANUFACTURING METAL LITHIUM

(71) Applicant: RESEARCH INSTITUTE OF INDUSTRIAL SCIENCE & TECHNOLOGY, Pohang-si (KR)

(72) Inventors: Woon Kyoung Park, Pohang-si (KR); Dae Yeob Park, Pohang-si (KR); Kwang Seok Park, Pohang-si (KR); Woo Chul Jung, Pohang-si (KR)

(73) Assignee: RESEARCH INSTITUTE OF INDUSTRIAL SCIENCE & TECHNOLOGY, Pohang-si (KR)

( * ) Notice: Subject to any disclaimer, the term of this patent is extended or adjusted under 35 U.S.C. 154(b) by 124 days.

(21) Appl. No.: 16/308,079

(22) PCT Filed: Jun. 7, 2016

(86) PCT No.: PCT/KR2016/005992

§ 371 (c)(1),
(2) Date: Dec. 7, 2018

(87) PCT Pub. No.: WO2017/213272

PCT Pub. Date: Dec. 14, 2017

(65) Prior Publication Data

US 2019/0264343 A1 Aug. 29, 2019

(51) Int. Cl.
*C25C 3/20* (2006.01)
*C25C 3/02* (2006.01)
(Continued)

(52) U.S. Cl.
CPC ..... *C25C 3/02* (2013.01); *C25C 3/00* (2013.01); *C25C 5/04* (2013.01); *C25C 7/08* (2013.01)

(58) Field of Classification Search
CPC .. C25C 3/02; C25C 7/005; C25C 1/02; C25C 3/00; C25C 3/20
See application file for complete search history.

(56) References Cited

U.S. PATENT DOCUMENTS 2,021,988 A 11/1935 Corson et al.
2,059,750 A * 11/1936 Roder ..... C22B 26/12 205/407

(Continued)

FOREIGN PATENT DOCUMENTS

CN 101573296 11/2009
CN 101760759 6/2010

(Continued)

OTHER PUBLICATIONS

JPO, Office Action of JP 2018-564365 dated Jan. 28, 2020.
SIPO, Search Report of CN 201680086567.2 dated Dec. 10, 2020.

*Primary Examiner* — Zulmariam Mendez
(74) *Attorney, Agent, or Firm* — Lex IP Meister, PLLC

(57) ABSTRACT

The present invention relates to a method for producing metallic lithium, and specifically a method for preparing lithium metal according to an embodiment of the present invention, comprises: preparing lithium phosphate; preparinge a mixture by adding a chlorine compound to the lithium phosphate; heating the mixture; obtaining lithium chloride by reacting the lithium phosphate and the chloride compound in the mixture; producing molten lithium metal by electrolyzing the lithium chloride; and recovering the molten lithium metal is disclosed.

12 Claims, 4 Drawing Sheets

(51) Int. Cl.

| | |
|---|---|
| ***C25C 5/04*** | (2006.01) |
| ***C25C 7/08*** | (2006.01) |
| ***C25C 3/00*** | (2006.01) |

(56) References Cited

U.S. PATENT DOCUMENTS

| | | | | |
|---|---|---|---|---|
| 2,073,631 | A * | 3/1937 | Gilbert | C25C 3/02<br>205/409 |
| 2,595,176 | A | 4/1952 | Sprauer | |
| 2,931,703 | A | 4/1960 | Reader | |
| 4,617,098 | A | 10/1986 | Verdier et al. | |
| 2012/0073984 | A1 | 3/2012 | Saito et al. | |
| 2014/0037521 | A1* | 2/2014 | Harrison | C01G 45/1228<br>423/179.5 |
| 2015/0014184 | A1* | 1/2015 | Swonger | C25C 7/04<br>205/560 |

FOREIGN PATENT DOCUMENTS

| | | | | |
|---|---|---|---|---|
| CN | 102409174 | | 4/2012 | |
| CN | 104925837 | | 9/2015 | |
| GB | 849969 | * | 4/1959 | C25C 3/04 |
| JP | S54-043811 | | 4/1979 | |
| JP | S60-190587 | | 9/1985 | |
| JP | 05-017832 | | 1/1993 | |
| JP | 2013-535573 | | 9/2013 | |
| JP | 5587500 | | 9/2014 | |
| JP | 2018-522709 | | 8/2018 | |
| KR | 10-2012-0021675 | | 3/2012 | |
| KR | 10-2012-0123979 | | 11/2012 | |
| KR | 10-2016-0002577 | | 1/2016 | |
| KR | 10-2016-0076021 | | 6/2016 | |

* cited by examiner

METHOD FOR MANUFACTURING METAL LITHIUM

TECHNICAL FIELD

It is disclosed a method for preparing lithium metal.

PRIOR ART

Generally, lithium metal is widely used in various industries such as lithium batteries, glass, ceramics, alloys, lubricants, and pharmaceuticals.

As a method for producing such metallic lithium, a process by heat reduction or electrolysis is generally used. Among them, the heat reduction is not available for commercialization due to economic and technical difficulties. On the other hand, in the case of a process for producing lithium metal by electrolysis, that is, molten salt electrolysis, lithium chloride is used as a raw material and the process is widely used on a commercial scale at present.

In this connection, it is generally known that a molten salt electrolytic process is a process of separating and recovering high-purity lithium metal by electrodepositing lithium from a molten lithium salt (LiCl—KCl or LiCl—$Li_2O$).

Specifically, lithium chloride (LiCl) and potassium chloride (KCl) are mixed and then heat-treated to prepare an eutectic mixture. Lithium chloride, which is a raw material of lithium, is added to the eutectic salt and melted. The cathode and anode are installed in the reaction apparatus, and electrolysis is performed by flowing a constant current or voltage.

At this time, the chloride ion ($Cl^-$) contained in the molten salt is oxidized to chlorine gas ($Cl_2$) at the anode, and lithium ion ($Li^+$) is reduced to metallic lithium at the cathode. The reduced lithium having a specific gravity of 0.534 g/cm is agglomerated in the liquid state on the upper part of the molten salt.

In order to recover the lithium metal in such a state, the lithium metal in the liquid state is solidified by cooling to the melting point or lower of the lithium metal, and then separated in the reaction tank.

However, since a known method for preparing metallic lithium is a method of adding lithium chloride to a molten salt, a material capable of producing lithium chloride by reacting with chlorine ($Cl_2$) or hydrochloric acid (HCl) can be used only as raw materials. (e.g. lithium carbonate ($Li_2CO_3$), lithium oxide ($Li_2O$), lithium hydroxide (LiOH), etc.)

Further, since the finally obtained lithium metal is easily oxidized by moisture and oxygen, it is also problematic that a raw material containing moisture is not used.

In addition, since a large amount of energy is consumed by repeating the process of heat treatment and cooling of the molten salt, and the lithium metal must be subjected to complicated steps until the lithium metal is finally recovered, there is a problem in that efficiency is lowered.

DISCLOSURE

Technical Problem

The present inventors have developed a process for producing lithium metal which can overcome the limitations of the above-mentioned raw materials and complicated process problems. The details of this are as follows.

According to an embodiment of the present invention, there is provided a method of preparing lithium chloride by using lithium phosphate as a raw material and electrolyzing the lithium chloride to recover lithium metal in a molten state.

Technical Solution

A method for preparing lithium metal according to an embodiment of the present invention, comprises: preparing lithium phosphate; preparinge a mixture by adding a chlorine compound to the lithium phosphate; heating the mixture; obtaining lithium chloride by reacting the lithium phosphate and the chloride compound in the mixture; producing molten lithium metal by electrolyzing the lithium chloride; and recovering the molten lithium metal.

Specifically, the method of an embodiment of the present invention further can comprise supplying the obtained lithium chloride continuously to a electrolytic bath where electrolysis is performed, after the step of obtaining lithium chloride by reacting the lithium phosphate and the chloride compound in the mixture.

The chloride compound may be calcium chloride ($CaCl_2$) or calcium chloride hydrate.

On the other hand, the step of heating the mixture is explained as follows.

The step of heating the mixture may be carried out in a temperature range of 500° C. to 900° C.

Independently, it may be performed for more than one hour.

The step of heating the mixture may be carried out in an air atmosphere.

In the step of heating the mixture, the mixture can further comprise lithium chloride, potassium chloride, or a mixture thereof.

The step of obtaining lithium chloride by reacting the lithium phosphate and the chloride compound in the mixture is as follows.

In the step of obtaining lithium chloride by reacting the lithium phosphate and the chloride compound in the mixture, chlorapatite ($Ca_5(PO_4)_3Cl$) may be produced as a by-product of the reaction.

The method of an embodiment of the present invention can further comprise: precipitating the chlorapatite ($Ca_5(PO_4)_3Cl$); and obtaining the lithium chloride by separating the precipitated chlorapatite ($Ca_5(PO_4)_3Cl$), after the step of obtaining lithium chloride by reacting the lithium phosphate and the chloride compound in the mixture.

On the other hand, the step of preparing lithium phosphate can comprise: removing impurities including magnesium, boron or calcium contained in a brine by adding a hydroxide anion to the brine to precipitate the impurities; and precipitating lithium phosphate from lithium contained in the brine by putting a phosphorus supplying material into the filtrate solution in which the impurities are removed.

Then, the step of producing molten lithium metal by electrolyzing the lithium chloride is explained as follows.

The step of producing molten lithium metal by electrolyzing the lithium chloride may be carried out in a temperature range of 350° C. to 1,300° C.

In the step of producing molten lithium metal by electrolyzing the lithium chloride, oxygen and/or moisture may be controlled to 50 ppm or less (except for 0 ppm).

In the step of producing molten lithium metal by electrolyzing the lithium chloride, a electrolyte used in the electrolysis may be the lithium chloride which is electrolyzed, other lithium chloride, potassium chloride, or a mixture thereof.

The step of recovering the molten lithium metal may be performed by a difference of specific gravity.

Effect

According to one embodiment of the present invention, by using lithium phosphate as a raw material for lithium chloride, it is possible to overcome the limit of raw materials generally limited to lithium carbonate ($Li_2CO_3$), lithium oxide ($Li_2O$), lithium hydroxide (LiOH). In addition, since the lithium phosphate can directly produce lithium chloride by reacting with a relatively inexpensive chloride compound, the manufacturing cost can be reduced.

In addition, lithium metal can be recovered without complicated processes by continuously supplying the lithium chloride to an electrolytic bath in which the electrolysis is performed.

In addition, since the lithium metal can be recovered by being cooled and recovered in a molten state without re-heat treatment, the energy and cost consumed in the recovery can be reduced.

DETAILED DESCRIPTION OF THE INVENTION

Hereinafter, embodiments of the present invention will be described in detail. However, it should be understood that the present invention is not limited thereto, and the present invention is only defined by the scope of the following claims.

Unless defined otherwise, all terms (including technical and scientific terms) used herein may be used in a sense commonly understood by one of ordinary skill in the art to which this invention belongs. When an element is referred to as "comprise" an element throughout the specification, it is to be understood that the element may include other elements, but not exclude other elements, unless specifically stated otherwise. Also, singular forms include plural forms unless the context clearly dictates otherwise.

A method for preparing lithium metal according to an embodiment of the present invention, comprises: preparing lithium phosphate; preparing a mixture by adding a chlorine compound to the lithium phosphate; heating the mixture; obtaining lithium chloride by reacting the lithium phosphate and the chloride compound in the mixture; producing molten lithium metal by electrolyzing the lithium chloride; and recovering the molten lithium metal.

Specifically, the method of an embodiment of the present invention further can comprise supplying the obtained lithium chloride continuously to a electrolytic bath where electrolysis is performed, after the step of obtaining lithium chloride by reacting the lithium phosphate and the chloride compound in the mixture.

This is a method of converting lithium phosphate into lithium chloride directly using the lithium phosphate and the chloride compound as a raw material, and electrolyzing the lithium chloride to recover the molten lithium metal.

According to one embodiment of the present invention, by using lithium phosphate as a raw material for lithium chloride, it is possible to overcome the limit of raw materials generally limited to lithium carbonate ($Li_2CO_3$), lithium oxide ($Li_2O$), lithium hydroxide (LiOH). In addition, since the lithium phosphate can directly produce lithium chloride by reacting with a relatively inexpensive chloride compound, the manufacturing cost can be reduced.

In addition, lithium metal can be recovered without complicated processes by continuously supplying the lithium chloride to an electrolytic bath in which the electrolysis is performed.

In addition, since the lithium metal can be recovered by being cooled and recovered in a molten state without re-heat treatment, the energy and cost consumed in the recovery can be reduced.

Figure 1:
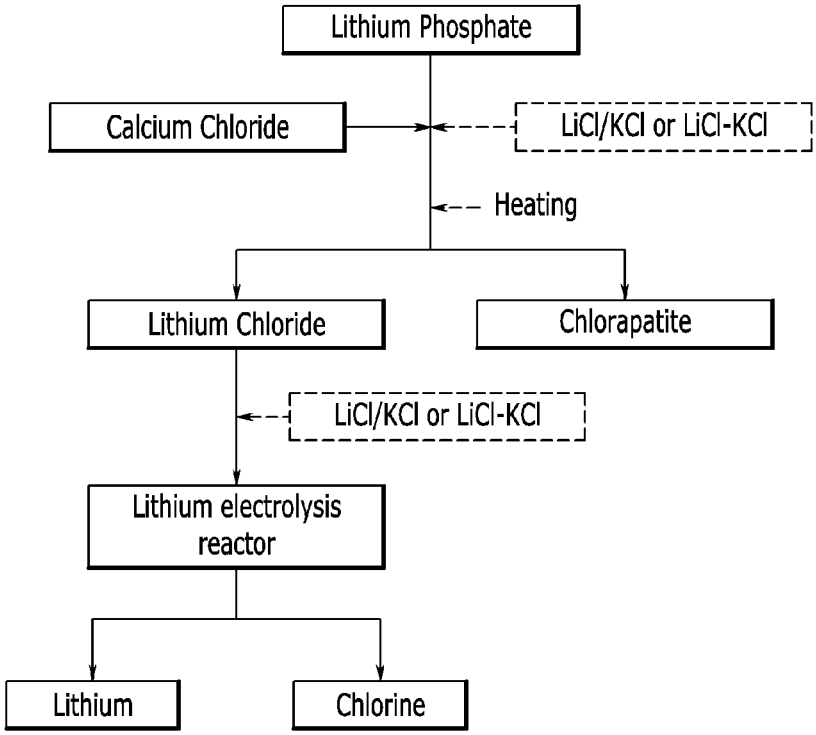
FIG. 1 is a flowchart schematically showing a method for producing lithium metal provided in an embodiment of the present invention.

FIG. 1 is a flow chart schematically showing a method for producing metallic lithium provided in an embodiment of the present invention, and the series of steps will be described with reference to the same.

According to FIG. 1, lithium phosphate and a chloride compound (for example, calcium chloride or calcium chloride hydrate) are prepared, mixed and then heat-treated to form a molten salt of lithium phosphate and the chloride compound, respectively. In the molten salt, the reaction of lithium phosphate and chloride in the molten salt can be carried out. The reaction can be carried out in a reaction tank containing lithium chloride, potassium chloride, or a mixture thereof.

As a result of the reaction, lithium chloride and byproducts (chlorapatite when the chloride compound is calcium chloride or calcium chloride hydrate) are generated. Then the lithium chloride is transferred to an electrolytic bath containing lithium chloride, potassium chloride, or a mixture thereof, and may be recovered as lithium metal. The step of recovery can be carried out in a molten state without cooling.

The molten salt means a salt in a molten state at a temperature above the melting point, and the lithium metal means lithium in a molten state by electrode-position in the cathode portion.

In addition, the reaction bath and the electrolytic bath may be included in one chamber, and lithium chloride produced in the reaction bath may be continuously supplied to the electrolytic bath.

Hereinafter, a method of preparing lithium metal provided in an embodiment of the present invention will be described in more detail.

The chloride compound is not particularly limited as long as it is a material that reacts with the lithium phosphate to directly produce lithium chloride.

As mentioned above, calcium chloride ($CaCl_2$) or calcium chloride hydrate may be used.

On the other hand, the step of heating the mixture is explained as follows.

The step of heating the mixture may be carried out in a temperature range of 500° C. to 900° C.

Specifically, since the reactivity between the lithium phosphate and the chloride compound is low at a temperature lower than 500° C., the lithium phosphate is hardly converted directly to the lithium chloride. In addition, since the finally recovered lithium metal is a substance which reacts with water and oxygen, it is necessary to control the moisture and oxygen by the step of heating at 500° C. or higher.

On the other hand, since the decomposition of by-products occurs at a temperature exceeding 900° C., it is necessary to perform the heat treatment at 900° C. or less.

Specifically, when the chlorapatite ($Ca_5(PO_4)_3Cl$) described below is the by-product, it can be decomposed into $Ca_3(PO_4)_2$, $Ca_4P_2O_9$, etc. at a temperature exceeding 900° C. These decomposition products cause a problem that the purity of the finally recovered lithium metal is lowered because the solubility of the ion is higher than that of chlorapatite.

Independently, it may be performed for more than one hour.

Specifically, when the heat treatment is performed for a short time of less than 1 hour, the reaction between the lithium phosphate and the chloride compound may not be completed.

In addition, the heat treatment may be performed in an air atmosphere, specifically, an argon atmosphere or a nitrogen atmosphere.

In the step of heating the mixture, the mixture can further comprise lithium chloride, potassium chloride, or a mixture thereof.

The step of obtaining lithium chloride by the reaction of lithium phosphate and chloride in the mixture is as follows.

As the mixture is heat-treated, lithium phosphate and chloride compound in the mixture can be reacted.

Specifically, when the chloride compound is calcium chloride or calcium chloride hydrate, the reaction of any one of the following reaction formulas 1 to 5 may be performed.

$$3Li_3PO_4(s)+5CaCl_2(s)\rightarrow LiCl(I)+Ca_5(PO_4)_3.Cl(s) \quad \text{[Reaction formula 1]}$$

$$3Li_3PO_4(s)+5CaCl_2.H_2O(s)\rightarrow LiCl(I)+Ca_5(PO_4)_3.Cl(s)+H_2O(g) \quad \text{[Reaction formula 2]}$$

$$3Li_3PO_4(s)+5CaCl_2.2H_2O(s)\rightarrow LiCl(I)+Ca_5(PO_4)_3.Cl(s)+2H_2O(g) \quad \text{[Reaction formula 3]}$$

$$3Li_3PO_4(s)+5CaCl_2.3H_2O(s)\rightarrow LiCl(I)+Ca_5(PO_4)_3.Cl(s)+5H_2O(g) \quad \text{[Reaction formula 4]}$$

$$3Li_3PO_4(s)+5CaCl_2.6H_2O(s)\rightarrow LiCl(I)+Ca_5(PO_4)_3.Cl(s)+6H_2O(g) \quad \text{[Reaction formula 5]}$$

In the above reaction formulas 1 to 5, lithium ions and chloride ions react with each other to produce lithium chloride, which is a raw material of metallic lithium. In addition, phosphate ion ($PO_4^{3-}$) reacts with calcium ion ($Ca^{2+}$) to form chlorapatite.

That is, as a by-product of the reaction, chlorapatite ($Ca_5(PO_4)_3Cl$) may be produced.

Since the chlorapatite has a specific gravity of 3.1 to 3.2, the chlorapatite exists as a precipitate on the bottom of the vessel in which the reaction occurs, thereby separating the chlorapatite and the lithium chloride.

The method of an embodiment of the present invention can further comprise: precipitating the chlorapatite ($Ca_5(PO_4)_3Cl$); and obtaining the lithium chloride by separating the precipitated chlorapatite ($Ca_5(PO_4)_3Cl$), after the step of obtaining lithium chloride by reacting the lithium phosphate and the chloride compound in the mixture.

The recovered lithium chloride can be transferred to an electrolytic bath, which is a reactor for producing metallic lithium. At this time, the obtained lithium chloride can be continuously supplied to the electrolytic bath in which the electrolysis is performed as described above.

On the other hand, the step of preparing lithium phosphate can comprise: removing impurities including magnesium, boron or calcium contained in a brine by adding a hydroxide anion to the brine to precipitate the impurities; and precipitating lithium phosphate from lithium contained in the brine by putting a phosphorus supplying material into the filtrate solution in which the impurities are removed.

The solubility of lithium phosphate ($Li_3PO_4$) is about 0.39 g/L. The solubility of lithium phosphate is very low compared with that of lithium carbonate. Accordingly, a phosphorus supplying material is provided into a lithium-containing solution such as brine to easily precipitate a small amount of lithium in a concentration of 0.5 to 1.5 g/L (from 2.75 to 16.5 g/L in terms of lithium phosphate) into solid lithium phosphate.

The lithium concentration in the brine can be 0.1 g/L or more. More specifically, the lithium concentration in the brine can be 0.2 g/L or more or 0.5 g/L or more. However, when it is 60 g/L or more, it takes a lot of time to increase the concentration of lithium, which is not economical.

At this time, at least one selected from phosphorus, phosphoric acid or phosphate is charged into the brine as the phosphorus supply material and reacts with lithium to generate lithium phosphate. In order for the lithium phosphate to precipitate in a solid state without being re-dissolved in the lithium-containing solution, its concentration (dissolved concentration in the brine) should be 0.39 g/L or more.

However, if the phosphorus supply material is a compound capable of changing the pH of the lithium-containing solution (for example, phosphoric acid), when the pH of the solution is lowered, lithium phosphate precipitated may be re-dissolved. To prevent this problem, hydroxide ions may be used together.

Specific examples of the phosphate include potassium phosphate, sodium phosphate, ammonium phosphate (specifically, the ammonium may be $(NH_4)_3PO_4$, and R is independently hydrogen, deuterium, substituted or unsubstituted C1 to C10 alkyl), etc.

More specifically, the phosphate is selected from the group consisting of potassium monophosphate, potassium diphosphate, potassium triphosphate, sodium monophosphate, sodium diphosphate, sodium triphosphate, aluminum phosphate, zinc phosphate, ammonium polyphosphate, sodium hexametaphosphate, calcium monophosphate, calcium diphosphate, calcium triphosphate, and the like.

The phosphorus supplying material may be water soluble. When the phosphorus supplying material is water soluble, the reaction with lithium contained in the brine can be facilitated.

The precipitated lithium phosphate can be separated from the brine by filtration and extracted.

Further, the step of adding a phosphorus supplying material into the brine to precipitate dissolved lithium into lithium phosphate can be carried out at room temperature. More specifically the step of adding a phosphorus supplying material into the brine to precipitate dissolved lithium into lithium phosphate can be carried out at 20° C. or higher, 30° C. or higher, 50° C. or higher, or 90° C. or higher.

Then, the step of electrolyzing the lithium chloride to produce molten lithium metal is explained as follows.

In the electrolytic bath in which the electrolysis is performed, the reaction of the following Reaction formula 6 is performed, so that the lithium metal in the molten state can be electro-deposited to the cathode portion of the electrolytic bath.

$$LiCl(I)\rightarrow Li(I)+\tfrac{1}{2}Cl_2(g) \quad \text{[Reaction formula 6]}$$

The step of producing molten lithium metal by electrolyzing the lithium chloride may be carried out in a temperature range of 350° C. to 1,300° C.

Specifically, in the case of a temperature exceeding 1,300° C., there is a problem that vaporization of the lithium metal occurs because the boiling point of the lithium metal is close to the above point. In addition, there is a problem that the molten salt cannot be liquefied at a temperature lower than 350° C.

In the step of producing molten lithium metal by electrolyzing the lithium chloride, oxygen and/or moisture may be controlled to 50 ppm or less (except for 0 ppm).

This is to prevent oxidation of lithium metal because the produced lithium metal is reactive with oxygen and/or moisture.

Further, it can be carried out in an inert gas atmosphere for preventing oxidation, such as argon gas or the like.

In the step of producing molten lithium metal by electrolyzing the lithium chloride, a electrolyte used in the electrolysis may be the lithium chloride which is electrolyzed, other lithium chloride, potassium chloride, or a mixture thereof.

That is, the same electrolyte as that used in the production of lithium chloride may be separately supplied, but lithium chloride produced from the lithium phosphate may be directly used as an electrolyte for electrolysis.

The step of recovering the molten lithium metal may be performed by a difference of specific gravity.

Figure 2:
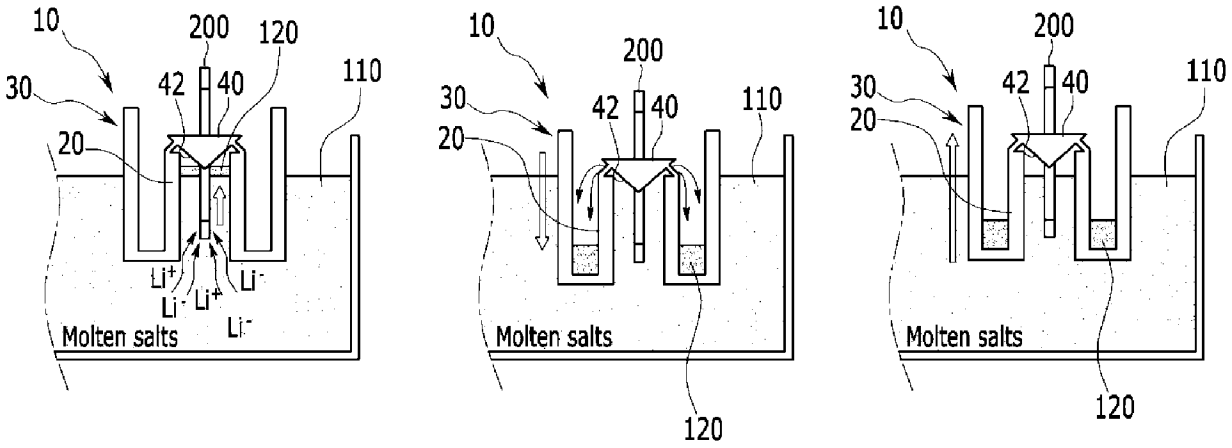
FIG. 2 schematically illustrates the recovery process of molten metal lithium provided in one embodiment of the present invention.

FIG. 2 is a schematic view showing the recovery process of the molten lithium metal, and will be described in detail with reference to FIG. 2.

The step of recovering the molten lithium metal includes the steps of lowering the inner cylinder 20 toward the bottom of the electrolytic bath 100 to lower the height of the upper end of the inner cylinder 20 relative to the molten salt water surface; a step of moving the lithium metal which is floating on top of molten salt by specific gravity difference to an outer recovery vessel 30 through an upper end of the inner cylinder 20 whose height is lowered; a step of raising the inner cylinder 20 to an original position; and a step of separating lithium metal collected from the recovery vessel 30.

When an electric current is applied to the cathode portion and the anode portion provided in the electrolytic bath 100, lithium metal is electrode-posited and aggregated in the cathode portion as the electrolysis process is performed. Since lithium metal has a smaller specific gravity than the molten salt, it floats above the molten salt in the molten state and forms the upper layer.

When a sufficient amount of lithium metal is collected on the molten salt through the electrolytic process, the inner cylinder 20 of the apparatus is lowered to the lower portion of the electrolytic bath 100. If the inner cylinder 20 is lowered, the upper end of the inner cylinder 20 moves to the lithium metal position floating on the molten salt.

As shown in FIG. 2, the upper end of the inner cylinder 20 is lower than the lithium metal, and the lithium metal moves through the upper end of the inner cylinder 20 to the recovery vessel 30. Therefore, the lithium metal floating on the molten salt water surface in the molten state is separated from the molten salt, falls into the recovery vessel 30, and is separated and collected into the internal space.

When the inner cylinder 20 is lowered, the guide member 40 connected to the inner cylinder 20 is also lowered, and the guide member 40 pushes the collected lithium metal in the inner cylinder 20 to the outside. The lower end of the guide member 40 forms the inclined surface 42. When the guide member 40 continues to descend, the inclined surface 42 moves below the molten salt surface and the area between the inclined surface 42 and the molten salt surface gradually is decreased. The lithium metal floated on the molten salt is pushed outward along the inclined surface 42 of the guide member 40 so that the lithium metal floated on the molten salt flows through the passage 22 formed between the upper end of the inner cylinder 20 and the guide member 40.

In the lithium metal recovery process, the inner cylinder 20 maintains the upper end thereof not to go below the molten salt level of the electrolytic bath 100, and adjusts the lowering height thereof. Accordingly, it is possible to prevent the molten salt from flowing out through the upper end of the inner cylinder 20 during the movement of the lithium metal.

When all the lithium metal is recovered, the inner cylinder 20 is moved upward to return to the original position. The lithium metal may be continuously collected into the recovery vessel 30 by repeating the above-described process.

Hereinafter, preferred embodiments of the present invention and experimental examples will be described. However, the following examples are merely preferred embodiments of the present invention, and the present invention is not limited to the following examples.

In the following Examples, a method of separating and recovering high-purity lithium metal through a process of reacting lithium phosphate with calcium chloride or calcium chloride hydrate to convert it to lithium chloride and a process of continuously electrolyzing the converted lithium chloride will be described as an example do.

EXAMPLE 1

(1) Preparation of Lithium Chloride

The mixture of lithium phosphate:calcium chloride to a molar ratio of 3:5 is prepared, and then the mixture is introduced into a reaction bath filled with lithium chloride. At this time, the reaction bath is contained in a chamber at a temperature of at least 610° C., that is, a temperature higher than the melting point of the lithium chloride, and is heat-treated for at least 1 hour.

By the heat treatment, the lithium phosphate reacts with the calcium chloride to convert it to lithium chloride, and chlorapathide is produced as a by-product. The reaction is according to the above-mentioned Reaction formula 1.

$$3Li_3PO_4(s)+5CaCl_2(s)\rightarrow LiCl(I)+Ca_5(PO_4)_3.Cl(s) \quad \text{[Reaction formula 1]}$$

(2) Recovery of Metallic Lithium

The obtained lithium chloride is transferred to the electrolytic bath where electrolysis is performed. At this time, the electrolytic bath is contained in a chamber heated to at least 610° C.

Specifically, the electrolytic bath includes an anode and a cathode. The electrolytic reaction bath includes a cathode for applying a cathode current to the molten salt and an anode for applying an electric current. The electrolyte includes lithium chloride, a eutectic salt (LiCl—KCl) or potassium chloride. Transferred lithium chloride can also be used directly as an electrolyte.

When the transferred lithium chloride is electrolyzed by applying a voltage of 2.4 V or more, lithium ions present in the molten salt are electrodeposited, concentrated and reduced to lithium metal as the electrolysis process proceeds according to the above-mentioned Reaction formula 6.

$$LiCl(I)\rightarrow Li(I)+\tfrac{1}{2}Cl_2(g) \quad \text{[Reaction formula 6]}$$

At this time, since the lithium metal floats on the molten salt due to the specific gravity difference in the molten state, the lithium metal can be easily separated and recovered. Specifically, the recovery apparatus was periodically reciprocated up and down to a depth of 1 cm to recover the liquid lithium metal into the recovery vessel of the recovery apparatus.

EXAMPLE 2

(1) Preparation of Lithium Chloride

The mixture of lithium phosphate:calcium chloride to a molar ratio of 3:5 is prepared, and then the mixture is introduced into a reaction bath filled with the eutectic salt (LiCl—KCl). At this time, the reaction bath is contained in a chamber at a temperature of at least 500° C., and is heat-treated for at least 1 hour.

By the heat treatment, the same reaction as in Example 1 is carried out. By the heat treatment, the lithium phosphate reacts with the calcium chloride to convert it to lithium chloride, and chlorapathide is produced as a by-product. The reaction is according to the above-mentioned Reaction formula 1.

(2) Recovery of Metallic Lithium

The lithium metal in the molten state is recovered through the same procedure as in Example 1.

EXAMPLE 3

(1) Preparation of Lithium Chloride

The mixture of lithium phosphate:calcium chloride to a molar ratio of 3:5 is prepared, and then the mixture is introduced into a reaction bath filled with potassium chloride. At this time, the reaction bath is contained in a chamber at a temperature of at least 700° C., and is heat-treated for at least 1 hour.

Specifically, the melting point of the potassium chloride is 770° C., but the heat treatment is performed at 700° C. or higher in consideration of the fact that the melting point is lowered by the reaction product lithium chloride.

By the heat treatment, the same reaction as in Example 1 is carried out. By the heat treatment, the lithium phosphate reacts with the calcium chloride to convert it to lithium chloride, and chlorapathide is produced as a by-product. The reaction is according to the above-mentioned Reaction formula 1.

(2) Recovery of Metallic Lithium

The lithium metal in the molten state is recovered through the same procedure as in Example 1.

EXAMPLE 4

(1) Preparation of Lithium Chloride

The mixture of lithium phosphate:calcium chloride to a molar ratio of 3:5 is prepared, and then the mixture is introduced into a reaction bath. At this time, the reaction bath is contained in a chamber at a temperature of at least 600° C., and is heat-treated for at least 1 hour.

Specifically, the melting point of the lithium chloride is 610° C., but the heat treatment is performed at 600° C. or higher in consideration of the fact that the melting point is lowered by the reaction product calcium chloride.

By the heat treatment, the lithium phosphate reacts with the calcium chloride to convert it to lithium chloride, and chlorapathide is produced as a by-product. The reaction is according to the above-mentioned Reaction formula 2.

$$3Li_3PO_4(s)+5CaCl_2.H_2O(s)\rightarrow LiCl(l)+Ca_5(PO_4)_3.Cl(s)+H_2O(g) \quad \text{[Reaction formula 2]}$$

(2) Recovery of Metallic Lithium

The lithium metal in the molten state is recovered through the same procedure as in Example 1.

EXPERIMENTAL EXAMPLE 1

Figure 3:
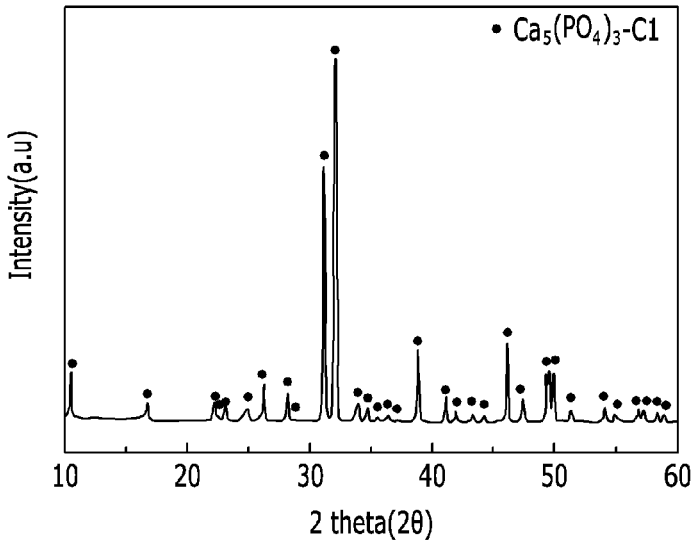
FIG. 3 shows an X-ray diffraction pattern for by-products produced in an embodiment of the present invention.

FIG. 3 shows X-ray diffraction patterns of by-products produced as a result of the lithium chloride production reaction of Example 1.

According to FIG. 3, it can be confirmed that the lithium phosphate reacts with the calcium chloride to produce chlorapatide as a by-product. In this regard, the chlorapatide is poorly soluble and can be easily removed by precipitation.

That is, it can be estimated that the lithium phosphate reacts with the calcium chloride to convert it to lithium chloride, precipitates the by-product chlorapatite to easily separate the lithium chloride, and can be used as a raw material for the production of lithium metal.

EXPERIMENTAL EXAMPLE 2

Figure 4:
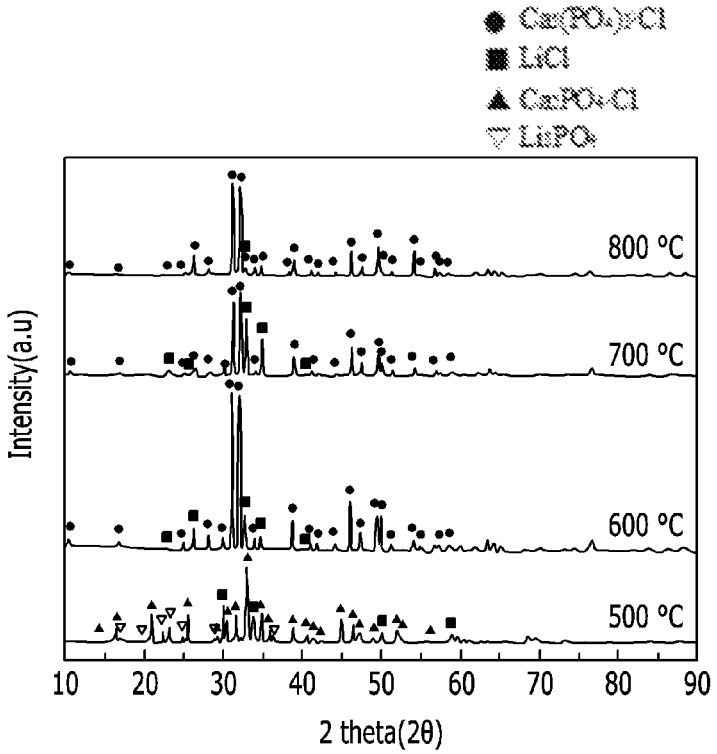
FIG. 4 shows an X-ray diffraction pattern for lithium chloride produced in an embodiment of the present invention.

FIG. 4 shows an X-ray diffraction pattern of the product of the lithium chloride production reaction of Example 2.

Specifically, in Example 2, the heat treatment temperature was varied to 500, 600, 700, and 800° C.

At all the heat treatment temperatures shown in FIG. 4, lithium chloride and chlorapatite are produced as a result of the reaction of lithium phosphate and calcium chloride hydrate.

Accordingly, it can be estimated that the reaction can be performed at a temperature of at least 500° C., and the chlorapatite, which is a by-product of the reaction, can be precipitated to easily separate the lithium chloride and lithium phosphate can be used as a raw material for lithium metal production.

EXPERIMENTAL EXAMPLE 3

The method of measuring the purity was performed by component analysis and content analysis using inductively coupled plasma (ICP) apparatus analysis.

The lithium metal recovered in Example 1 contains only 0.97 wt % impurity, and shows a high purity of 99.03 wt %.

Therefore, it can be estimated that lithium chloride is produced from lithium phosphate according to Example 1, and the produced lithium chloride is electrolyzed, whereby high-purity lithium metal can be recovered.

The present invention is not limited to the above-described embodiments, but may be formed in various forms, and it will be understood by those skilled in the art that various changes in form and details may be made therein without departing from the spirit and scope of the invention as defined by the appended claims. It is therefore to be understood that the above-described embodiments are illustrative in all aspects and not restrictive.

| [Description of symbol] | |
|---|---|
| 10: recovery apparatus | 20: inner cylinder |
| 22: passage | 30: recovery vessel |
| 32: Side member | 34: bottom member |
| 40: guide member | 42: inclined surface |
| 44: Supporting member | 46: hole |
| 100: electrolytic bath | 110: molten salt |
| 120: lithium metal | 200: cathode |

The invention claimed is:

1. A method for preparing lithium metal, comprising:

preparing lithium phosphate;

preparing a mixture by adding a chloride compound to the lithium phosphate;

heating the mixture;

obtaining lithium chloride by reacting the lithium phosphate and the chloride compound in the mixture;

producing molten lithium metal by electrolyzing the lithium chloride; and recovering the molten lithium metal in a molten state, wherein the recovering includes collecting the molten lithium metal by reciprocating a recovery apparatus up and down, wherein the chloride compound is calcium chloride ($CaCl_2$) or calcium chloride hydrate, and wherein the step of heating the mixture is carried out in a temperature range of 500° C. to 900° C.

2. hod of claim 1, further comprising:

supplying the obtained lithium chloride continuously to a electrolytic bath where electrolysis is performed, after the step of obtaining lithium chloride by reacting the lithium phosphate and the chloride compound in the mixture.

3. The method of claim 1, wherein the step of heating the mixture is carried out for 1 hour or more.

4. The method of claim 1, wherein the step of heating the mixture is carried out in an air atmosphere.

5. The method of claim 1, wherein in the step of heating the mixture, the mixture further comprises lithium chloride, potassium chloride, or a mixture thereof.

6. The method of claim 1, wherein in the step of obtaining lithium chloride by reacting the lithium phosphate and the chloride compound in the mixture, chlorapatite ($Ca_5(PO_4)_3Cl$) is produced as a by-product of the reaction.

7. The method of claim 6, further comprising:

precipitating the chlorapatite ($Ca_5(PO_4)_3Cl$); and obtaining the lithium chloride by separating the precipitated chlorapatite ($Ca_5(PO_4)_3Cl$), after the step of obtaining lithium chloride by reacting the lithium phosphate and the chloride compound in the mixture.

8. The method of claim 1, wherein the step of preparing lithium phosphate comprising:

removing impurities including magnesium, boron or calcium contained in a brine by adding a hydroxide anion to the brine to precipitate the impurities; and precipitating lithium phosphate from lithium contained in the brine by putting a phosphorus supplying material into the filtrate solution in which the impurities are removed.

9. The method of claim 1, wherein the step of producing molten lithium metal by electrolyzing the lithium chloride is carried out in a temperature range of 350° C. to 1,300° C.

10. The method of claim 1, wherein in the step of producing molten lithium metal by electrolyzing the lithium chloride, oxygen and/or moisture is controlled to 50 ppm or less (except for 0 ppm).

11. The method of claim 1, wherein in the step of producing molten lithium metal by electrolyzing the lithium chloride, a electrolyte used in the electrolysis is the lithium chloride which is electrolyzed, other lithium chloride, potassium chloride, or a mixture thereof.

12. The method of claim 1, wherein the step of recovering the molten lithium metal is performed by a difference of specific gravity.

* * * * *